United States Patent [19]

Yamamoto et al.

[11] Patent Number: 4,927,724

[45] Date of Patent: May 22, 1990

[54] METHOD AND APPARATUS FOR COLOR ELECTROPHOTOGRAPHY

[75] Inventors: Hajime Yamamoto, Osaka; Yuji Takashima, Nishinomiya; Kazunori Kitagaki, Utsunomiya; Masahiko Nakamura, Osaka, all of Japan

[73] Assignee: Matsushita Electric Industrial Co., Ltd., Osaka, Japan

[21] Appl. No.: 269,751

[22] Filed: Nov. 8, 1988

[30] Foreign Application Priority Data

Nov. 18, 1987 [JP] Japan ..... 62-291055

[51] Int. Cl.[5] ..... G03G 13/01

[52] U.S. Cl. ..... 430/45; 430/42; 355/327; 355/326

[58] Field of Search ..... 430/42, 45; 355/327

[56] References Cited

U.S. PATENT DOCUMENTS 4,809,038 2/1989 Yamamoto et al. ..... 430/42 X

FOREIGN PATENT DOCUMENTS 2461702 10/1975 Fed. Rep. of Germany ..... 430/42

2092068 8/1982 United Kingdom ..... 430/42

*Primary Examiner*—Roland E. Martin

*Attorney, Agent, or Firm*—Lowe, Price, LeBlanc, Becker & Shur

[57] ABSTRACT

A charging process, an exposure process, and a development process are performed to form a toner image on a photosensitive member for each of a plurality of different colors. The toner images for the respective colors form a composite color image. Second color toner image forming processes are effected subsequently to first color toner image forming processes. The first color charging process charges the photosensitive member to a first potential. The second color charging process charges the photosensitive member to a second potential. The second potential is set equal to or lower than the first potential. The composite color image is transferred to a sheet.

14 Claims, 4 Drawing Sheets

METHOD AND APPARATUS FOR COLOR ELECTROPHOTOGRAPHY

BACKGROUND OF THE INVENTION

This invention relates to a method and an apparatus for color electrophotography.

In some methods of color electrophotography, toner images of different colors are formed by repeating charging, exposure, and development, and then the toner images are transferred to a sheet together to form a final composite color image.

SUMMARY OF THE INVENTION

It is an object of this invention to provide an excellent method and an excellent apparatus for color electrophotography.

In accordance with this invention, a charging process, an exposure process, and a development process are performed to form a toner image on a photosensitive member for each of a plurality of different colors. The toner images for the respective colors form a composite color image. Second color toner image forming processes are effected subsequently to first color toner image forming processes. The first color charging process charges the photosensitive member to a first potential. The second color charging process charges the photosensitive member to a second potential. The second potential is set equal to or lower than the first potential. The composite color image is transferred to a sheet.

BRIEF DESCRIPTION OF THE DRAWINGS

The same reference numerals denote corresponding or like elements throughout the drawings.

DESCRIPTION OF THE PREFERRED EMBODIMENTS

This invention is an improvement of a conceivable apparatus for color electrophotography, which will be described hereinafter with referece to FIGS. 1 and 2 for a better understanding of this invention. It should be noted that the conceivable apparatus of FIGS. 1 and 2 is not a prior art to this invention.

The conceivable apparatus sequentially performs a black toner image forming step, a yellow toner image forming step, a magenta toner image forming step, and a cyan toner image forming step to produce a composite color toner image. Each of these different color toner image forming steps includes a charging process, an exposure process, and a development process. In a composite color toner image produced by the conceivable apparatus, black toner portions surrounded by yellow toner portions tend to run into the yellow toner portions. The causes of this phenomenon will be described hereinafter.

Figure 1:
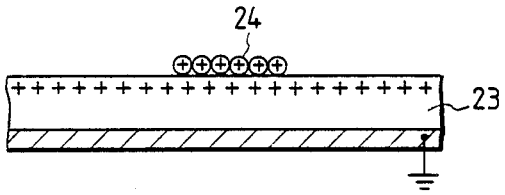
FIG. 1 is a diagram of a photosensitive member and a black toner layer in a conceivable apparatus for color electrophotography.

As shown in FIG. 1, during the black toner image forming step, layers of black toner 24 which form a black toner image are fixed on a photosensitive member 23. It should be noted that FIG. 1 shows only one of the black toner layers 24. During the yellow toner image forming step subsequent to the black toner image forming step, a general corona charging device charges the photosensitive member 23 by exposing the member 23 to corona from above the black toner layers 24. As a result, the black toner layers 24 are charged to about 100 V while the portions of the photosensitive member 23 which extend below the black toner layers 24 are charged to about 700 V. The portions of the photosensitive member 23 which are uncovered from the black toner layers 24 are also charged to about 800 V. As shown in FIG. 2, during the exposure process in the yellow toner image forming step, when yellow-related signal light 25 is applied to portions of the photosensitive member 23 which surround the black toner layers 24, the potential of these exposure portions of the photosensitive member 23 is lowered to about 50 V but the potential of the portions of the photosensitive member 23 which are covered by the black toner layers 24 remains at about 700 V. Accordingly, there are great potential differences between the portions of the photosensitive member 23 which are covered by the black toner layers 24 and the portions of the photosensitive member 23 which were exposed to the yellow-related signal light 25. The great potential differences induce the black toner to run from the edges of the black toner image into the yellow exposure portions of the photosensitive member 23.

Figure 2:
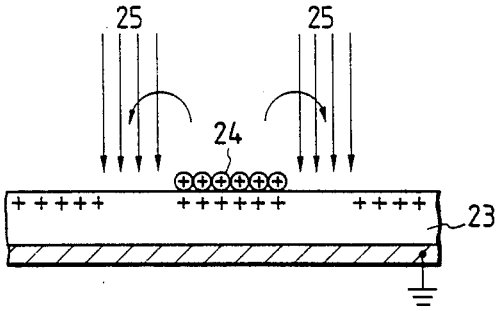
FIG. 2 is a diagram of the photosensitive member, the black toner layer, and yellow-related signal light in the conceivable apparatus.

This invention was carried out in view of the previously-mentioned drawback in the conceivable apparatus of FIGS. 1 and 2. This invention will be described in detail hereinafter.

In this invention, the charged potential of a photosensitive member is preferably in the range of 300 V to 700 V during a yellow toner image forming step for the following reasons. In cases where the photosensitive member is charged to a potential above 700 V during the yellow toner image forming step, when a yellow image portion surrounds a black image portion, black toner tends to run from edges of the black image into the yellow portion. In cases where the photosensitive member is charged to a potential below 300 V during the yellow toner image forming step, some difficulty arises in forcing yellow toner to fly and thus a satisfactory yellow development process tends to fail. While a higher surface potential of the photosensitive member generally enables a toner image with a higher contrast, human eyes tend to less sensitively resolve a yellow image than other color images so that a high contrast of the yellow image is generally unnecessary and a lower charged potential of the photosensitive member is acceptable during the yellow toner image forming step. Between a development process in the yellow toner image forming step and a charging process in the subsequent magenta toner image forming step, and between a development process in the magenta toner image forming step and a charging process in the subsequent cyan toner image forming step, the removal of charges from the photosensitive member via an optical process is preferably avoided in order to prevent the black toner from spreading and running during a subsequent stage. During the black toner image forming step, the charged potential of the photosensitive member is preferably equal to or higher than 700 V to obtain a high image contrast. Accordingly, the charged potential of the photosensitive member during the black toner image forming step is preferably higher than the charged potential of the photosensitive member during the yellow toner image forming step. To decrease the surface potential of the photosensitive member during the yellow toner image forming step which follows the black toner image forming step, it is preferable that charges are removed from the photosensitive member after the development process in the black toner image forming step but before the charging process in the yellow toner image forming step. This charge removal may use an optical charge removing technique or an ac corona charge removing technique. To obtain magenta and cyan toner images with high contrasts, the charged potentials of the photosensitive member are preferably equal to or higher than 700 V during the magenta toner image forming step and the cyan toner image forming step.

Figure 3:
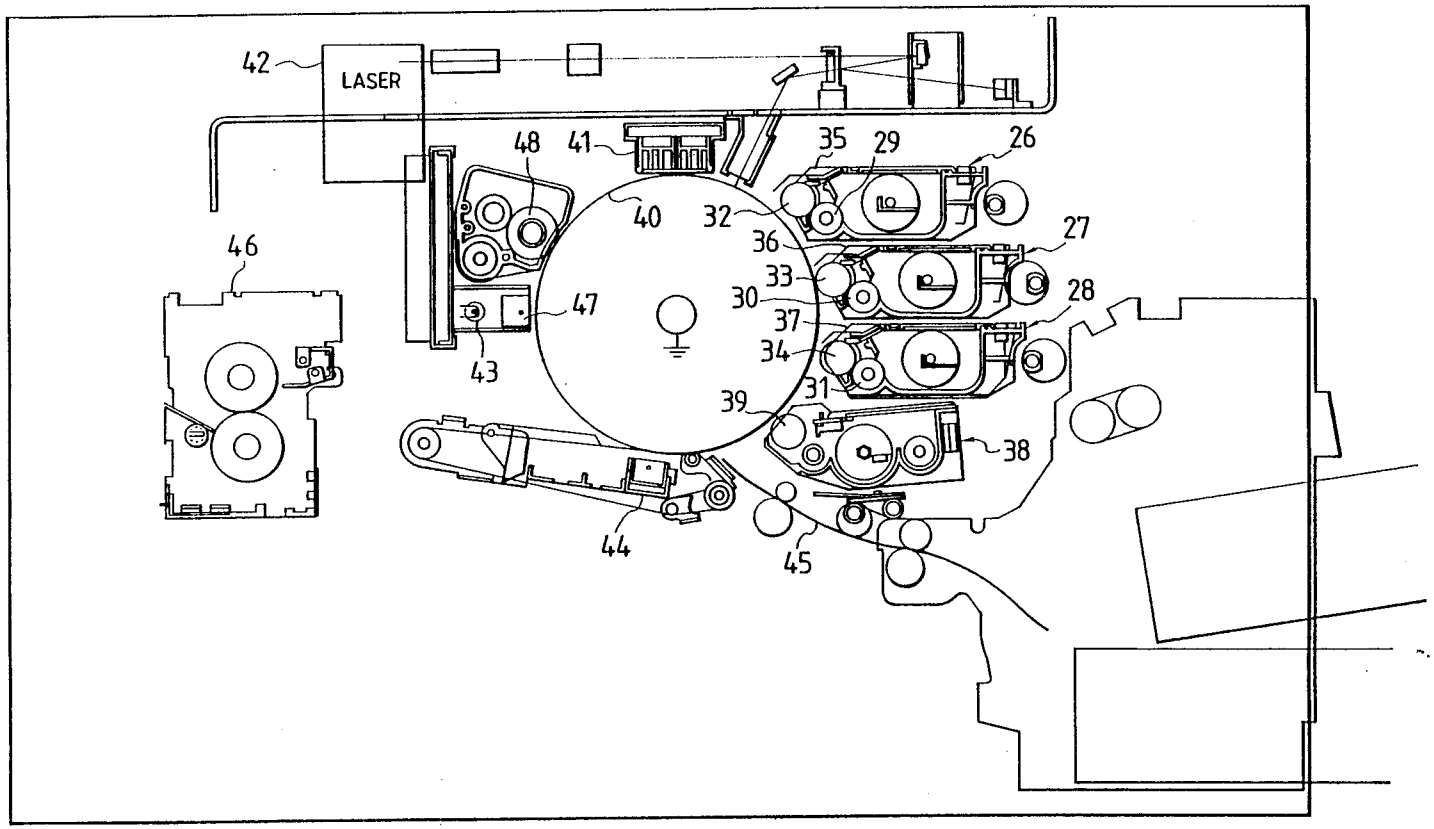
FIG. 3 is a diagram of an apparatus for color electrophotography according to a first embodiment of this invention.

With reference to FIG. 3, an apparatus for color electrophotography according to a first embodiment of this invention includes noncontact and nonmagnetic development devices 26, 27, and 28 which contain yellow, magenta, and cyan insulative toners respectively. The development devices 26, 27, and 28 which contain yellow, magenta, and cyan insulative toners respectively. The development devices 26, 27, and 28 use dc electric fields and thereby force the toners to fly. In the development devices 26, 27, and 28, electrically conductive fur brushes 29, 30, and 31 contact developing rollers 32, 33, and 34 made of aluminum respectively. The developing rollers 32, 33, and 34 are rotated by suitable drive mechanisms. During rotation of the developing rollers 32, 33, and 34, the fur brushes 29, 30, and 31 charge the toners in triboelectric processes. The development devices 26, 27, and 28 also include blades 35, 36, and 37 which form thin layers of the toners on the developing rollers 32, 33, and 34 respectively. A development device 38 of a contact type contains developer having two components, that is, black insulative toner and magnetic carrier. The development device 38 includes a developing roller 39 which is rotated by a suitable drive mechanism. The development devices 26, 27, 28, and 38 are located around a cylindrical photosensitive member 40. Each of the development devices 26, 27, 28, and 38 is moved into and held in a given position close to the photosensitive member 40 during a developing process for the corresponding color and is moved away from the given position during other periods. These movements of the development devices 26, 27, 28, and 38 are performed by a known selective drive mechanism.

The black development device 38 is designed as follows The diameter of the developing roller 39 is 22 mm (millimeters). The developing roller 39 is rotated at a peripheral speed of 320 mm/s. The thickness of a layer of developer on the developing roller 39 is 400 micrometers. The direction of rotation of the developing roller 39 is opposite to the direction of rotation of the photosensitive member 40. Accordingly, in a region where the developing roller 39 and the photosensitive member 40 oppose each other, the developing roller 39 and the photosensitive member 40 move essentially in the same direction. The gap between opposing surfaces of the developing roller 39 and the photosensitive member 40 is 300 micrometers during a developing process for black and is 2 millimeters during other color processes.

The developer used in the black development device 38 is designed as follows. The developer has two components, that is, toner and carrier. The carrier includes particles, the average diameter of which is about 50 micrometers. The carrier is made of ferrite coated with Teflon. The quantity of charge of the toner is +10 microcoulombs per gram. The toner includes particles, the average diameter of which is 8 micrometers. The relative dielectric constant of the toner is about 2.

The yellow development device 26 is designed as follows. The diameter of the developing roller 32 is 20 mm. The developing roller 32 is rotated at a peripheral speed of 160 mm/s. The direction of rotation of the developing roller 32 is opposite to the direction of rotation of the photosensitive member 40. Accordingly, in a region where the developing roller 32 and the photosensitive member 40 oppose each other, the developing roller 32 and the photosensitive member 40 move essentially the same direction. The thickness of a layer of toner on the developing roller 32 is 30 micrometers. The gap between opposing surfaces of the developing roller 32 and the photosensitive member 40 is 150 micrometers during a developing process for yellow and is 2 millimeters during other color processes.

The toner used in the yellow development device 26 is designed as follows. The quantity of charge of the toner is +3 microcoulombs per gram. The toner includes particles, the average diameter of which is about 10 micrometers. The relative dielectric constant of the toner is about 2.

The magenta development device 27 and the cyan development device 28 are similar to the yellow development device 26. The toners used in the magenta development device 27 and the cyan development device 28 are similar to the toner of the yellow development device 26.

The photosensitive member 40 includes a drum made of photosensitive amorphous Se-Te having an enhanced sensitivity in an infrared range. The diameter of the photosensitive drum 40 is 152 mm. The photosensitive member 40 may include layers of photosensitive selenium-based material which have an enhanced sensitivity in an infrared range, a relative dielectric constant of about 7, and a thickness of 60 micrometers. The photosensitive member 40 is rotated by a motor in a known way.

A corona charging device 41 preferably composed of a scorotron charger serves to charge the photosensitive member 40 to adjustable potentials. An exposure device including a semiconductor laser 42 applies optical image information signals to the photosensitive member 40 to form corresponding electrostatic latent images on the photosensitive member 40. The semiconductor laser 42 emits light having a wavelength of 790 nm (nanometer). A lamp 43 serves to remove charges from the photosensitive member 40 in an optical process. A transfer device 44 attracts a composite color toner image from the photosensitive member 40 to a sheet 45 supplied by a suitable feeder. A fusing device 46 uses a thermal process and thereby permanently affixes the composite color toner image to the sheet 45. A charging device 47 and an electrically conductive fur brush 48 cooperate to clean the photosensitive member 40. The device 47 charges the photosensitive member 40 to a positive potential. The fur brush 48 remains pressed in contact with the photosensitive member 40. The fur brush 48 is subjected to a predetermined negative potential.

The apparatus of FIG. 3 operates as follows. The photosensitive member 40 is rotated at a peripheral speed of 160 mm/s. The photosensitive member 40 is charged to a potential of +900 V by the charging device 41 in a first charging process. During the first charging process, the charging device 41 is operated at a corona voltage of +7 kV and a grid voltage of +1 kV. After the first charging process, the photosensitive member 40 undergoes first exposure and is thus exposed to the light from the semiconductor laser 42 which represents a black-related information signal. During the first exposure, the intensity or power of the light on a surface of the photosensitive member 40 is set to 1.0 mW. The first exposure records the black-related information signal on the photosensitive member 40, forming a corresponding negative and thus forming an electrostatic latent image related to black. The yellow development device 26, the magenta development device 27, and the cyan development device 28 are deactivated so that they will not act on the latent image. Only the black development device 38 is activated. The latent image is reversely developed into a corresponding black toner image by the black development device 38. During this development, the developing roller 39 of the black development device 38 is subjected to a potential of +600 V. After the development, the lamp 43 removes charges from the photosensitive member 40. At this time, the black toner image is formed by a toner layer having a thickness of 10–20 micrometers and having a single sub-layer or two sub-layers.

Next, the photosensitive member 40 is charged to a potential of +600 V by the charging device 41 in a second charging process. During the second charging process, the charging device 41 is operated at a corona voltage of +7 kV and a grid voltage of +600 V. As a result, portions of the photosensitive member 40 which carry the black toner assume a potential of +600 V. After the second charging process, the photosensitive member 40 undergoes second exposure and is thus exposed to the light from the semiconductor laser 42 which represents a yellow-related information signal. During the second exposure, the intensity or power of the light on a surface of the photosensitive member 40 is set to 1.5 mW. The second exposure records the yellow-related information signal on the photosensitive member 40, forming a corresponding negative and thus forming an electrostatic latent image related to yellow. It was experimentally found that, at this stage, the black toner was prevented from running or spreading from edges of the black toner image into yellow image forming portions contiguous thereto. The yellow development device 26 is activated. The latent image is reversely developed into a corresponding yellow toner image by the yellow development device 26. During this development, the developing roller 32 of the yellow development device 26 is subjected to a potential of +600 V. The magenta development device 27, the cyan development device 28, and the black development device 38 are deactivated. In addition, the lamp 43 is deactivated so that it will not remove charges from the photosensitive member 40.

Subsequently, the photosensitive member 40 is charged to a potential of +810 V by the charging device 41 in a third charging process. During the third charging process, the charging device 41 is operated at a corona voltage of +7 kV and a grid voltage of +800 V. As a result, portions of the photosensitive member 40 which carry the black and yellow toners assume a potential of +810 V. After the third charging process, the photosensitive member 40 undergoes third exposure and is thus exposed to the light from the semiconductor laser 42 which represents a magenta-related information signal. The third exposure records the magenta-related information signal on the photosensitive member 40, forming a corresponding negative and thus forming an electrostatic latent image related to magenta. The yellow development device 26, the cyan development device 28, and the black development device 38 are detectivated. Only the magenta development device 27 is activated. The latent image is reversely developed into a corresponding magenta toner image by the magenta development device 27. During this development, the developing roller 33 of the magenta development device 27 is subjected to a potential of +800 V. Portions of the photosensitive member 40 in which the yellow toner and the magenta toner overlap are formed with a toner layer having a thickness of 20–40 micrometers and having two or four sub-layers. The lamp 43 is deactivated so that it will not remove charges from the photosensitive member 40.

Next, the photosensitive member 40 is charged to a potential of +840 V by the charging device 41 in a fourth charging process. As a result of the fourth charging process, portions of the photosensitive member 40 which carry either of the black, yellow, and magenta toners assume a potential of +800 V. In addition, red portions of the photosensitive member 40 in which the yellow toner and the magenta toner overlap assume a potential of +780 V. After the fourth charging process, the photosensitive member 40 undergoes fourth exposure and is thus exposed to the light from the semiconductor laser 42 which represents a cyan-related information signal. The fourth exposure records the cyan-related information signal on the photosensitive member 40, forming a corresponding negative and thus forming an electrostatic latent image related to cyan. The yellow development device 26, the magenta development device 27, and the black development device 38 are deactivated. Only the cyan development device 28 is activated. The latent image is reversely developed into a corresponding cyan toner image by the cyan development device 28. During this development, the developing roller 34 of the cyan development device 28 is subjected to a potential of +800 V. The black toner image, the yellow toner image, the magenta toner image, and the cyan toner image form a composite color toner image together on the photosensitive member 40.

The composite color toner image is transferred from the photosensitive member 40 to the sheet 45 by the transfer device 44. The sheet 45 which carries the composite color toner image is fed to the fusing device 46 by a suitable conveyor. The device 46 permanently affixes the composite color toner image to the sheet 45 in a thermal process.

After the composite color toner image is transferred from the photosensitive member 40 to the sheet 45, the surface of the photosensitive member 40 is charged to a positive potential by the charging device 47 and is then rubbed with the fur brush 48 so that the photosensitive member 40 is cleaned. During this cleaning process, the charging device 47 is operated at a corona voltage of +5.5 kV and the fur brush 48 is subjected to a voltage of −150 V.

It was experimentally found that, in a resulting color image, a composite color formed by red, green, and blue had a color density or strength equal to or higher than 1.5, and the black image portions which were surrounded by the yellow image portions were prevented from running into the yellow image portions.

Figure 4:
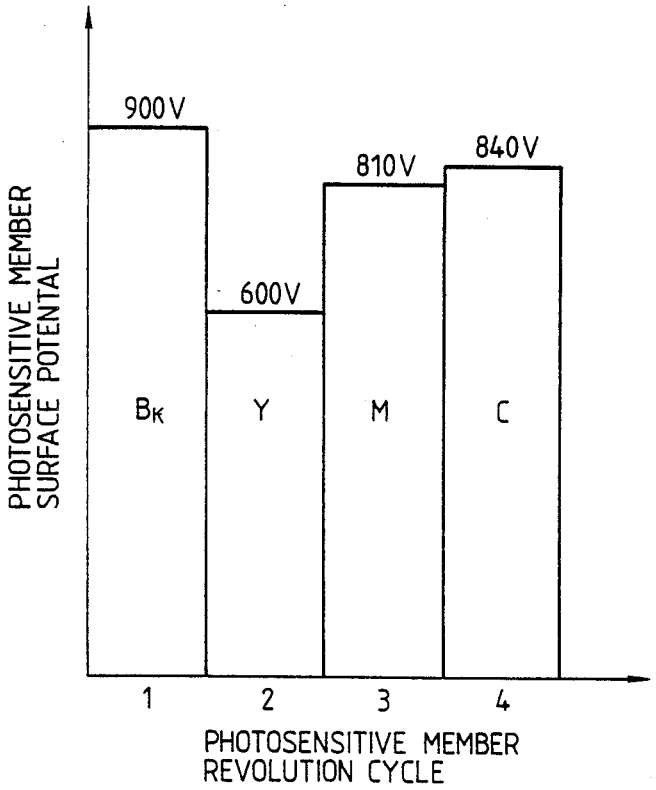
FIG. 4 is a diagram showing potentials of the surface of a photosensitive member which are caused by respective charging processes in the apparatus of FIG. 3.

As shown in FIG. 4, the surface of the photosensitive member 40 is charged by the charging device 41 to 900 V, 600 V, 810 V, and 840 V for black "Bk", yellow "Y", magenta "M", and cyan "C" respectively. Four revolutions of the photosensitive member 40 correspond to black "Bk", yellow "Y", magenta "M", and cyan "C" respectively and constitute one cycle of completing a composite color toner image.

The results of experiments on modifications of the apparatus of FIG. 3 will follow. In a first modification, a photosensitive member 40 was charged to +900 V and +920 V during first and second charging processes respectively. In this modification, black toner ran from edges of a black toner image into adjacent yellow portions at an unacceptable degree.

In a second modification, a photosensitive member 40 was charged to +900 V and +600 V during first and second charging processes respectively. After a yellow toner image was formed, a lamp 43 was activated to remove charges from the photosensitive member 40. Upon this charge removal, black toner moved out of a normal black toner image.

In a third modification, a photosensitive member 40 was charged to +600 V during each of third and fourth charging processes. In a resulting color image produced by this modification, a composite color formed by red, green, and blue had a color density or strength of about 0.8. In addition, the resulting color image had a low contrast.

Figure 5:
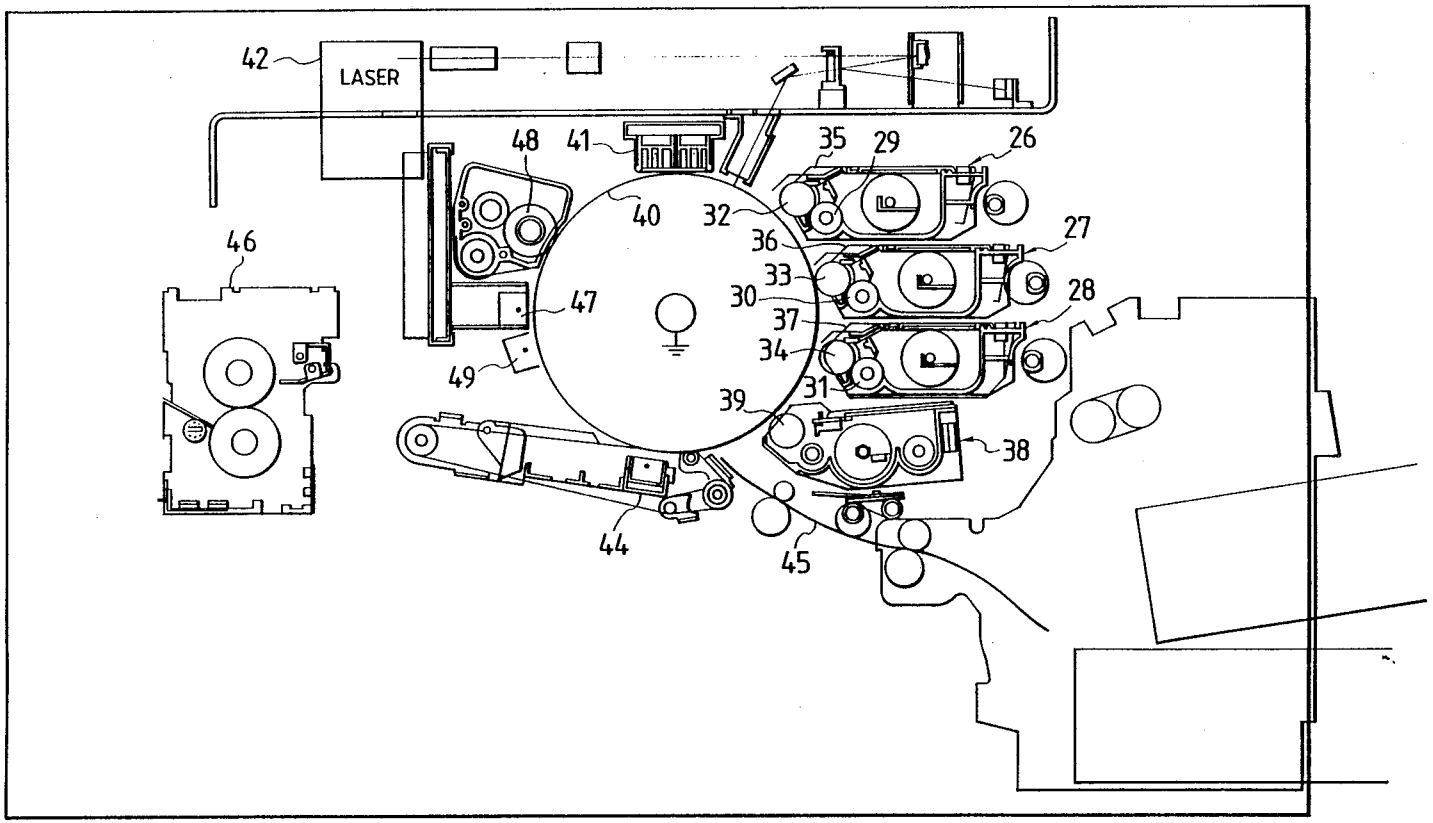
FIG. 5 is a diagram of an apparatus for color electrophotography according to a second embodiment of this invention.

FIG. 5 shows a second embodiment of this invention which is similar to the embodiment of FIG. 3 except for the following design change. As shown in FIG. 5, the second embodiment uses a corona charging device 48 in place of the lamp 43 of the embodiment of FIG. 3. The corona charging device 49 serves to remove charges from a photosensitive member 40. The corona charging device 49 is subjected to an ac voltage of 5 kVrms.

It was experimentally found that, in a resulting color image, a composite color formed by red, green, and blue had a color density or strength equal to or higher than 1.5, and the black image portions which were surrounded by the yellow image portions were prevented from running into the yellow image portions.

What is claimed is:

1. A method of color electrophotography comprising the steps of:

(a) performing a charging process, an exposure process, and a development process to form a toner image on a photosensitive member for each of a plurality of different colors, with the resulting toner images for the respective colors forming a composite color image, wherein yellow toner image forming processes are effected subsequent to black toner image forming processes, wherein the black charging process charges the photosensitive member to a first potential, the yellow charging process charges the photosensitive member to a second potential and the second potential is equal to or lower than the first potential, and wherein the charge on the photosensitive member resulting from the yellow toner image forming process is not removed by light exposure after the yellow toner image is formed; and (b) transferring the composite color image to a sheet.

2. The method of claim 1 wherein black, yellow, magenta, and cyan toner images are successively formed.

3. The method of claim 1 wherein the yellow development process comprises forcing toner to fly with a dc electric field.

4. The method of claim 1 wherein the second potential is in the range of 300 V to 700 V.

5. The method of claim 4 wherein the first potential is higher than the second potential.

6. The method of claim 1 wherein a charged potential of the photosensitive member is equal to or higher than 700 V during third color toner image forming processes which follow the yellow toner image forming processes.

7. The method of claim 1 further comprising the step of removing charges from the photosensitive member after the black toner image forming processes but before the yellow charging process.

8. The method of claim 7 wherein the charge removing step comprises using light to remove the charges from the photosensitive member.

9. The method of claim 7 wherein the charge removing step comprises using ac corona to remove the charges from the photosensitive member.

10. A method of color electrophotography comprising the steps of:

(a) performing a charging process, an exposure process, and a development process to from a toner image on a photosensitive member for each of black, yellow, magenta, and cyan, with the resulting toner images for the respective colors forming a composite color image, wherein the black development process is of a noncontact type and each of the yellow development process, the magenta development process, and the cyan development process forces toner to fly with a dc electric field, wherein the black toner image forming processes are effected first and the yellow toner image forming process are effected second, wherein a first charged potential of the photosensitive member in the black image forming processes is equal to or higher than 700 and charges are removed from the photosensitive member after the black toner image forming processes, and wherein after the charge removing step, a second charged potential of the photosensitive member in the yellow image forming processes is in the range of 300 V to 700 V, and wherein the charge on the photosensitive member resulting from the yellow toner image forming processes is not removed by light exposure the yellow toner image is formed; and (b) transferring the composite color image to a sheet.

11. An apparatus for color electrophotography comprising:

(a) means for performing a charging process, an exposure process, and a development process to from a toner image on a photosensitive member for each of black, yellow, magenta, and cyan, with the toner images for the respective colors forming a composite color image, wherein the means for performing the black development process is of a noncontact type, and wherein each of the means for performing the yellow development process, the magenta development process, and the cyan development process forces toner to fly with a dc electric field;

(b) means for transferring the composite color image to a sheet;

(c) means for effecting the black toner image forming processes first and the yellow toner image forming processes second;

(d) means for setting a first charged potential of the photosensitive member in the black toner image forming processes equal to or higher than 700 V;

(e) means for removing charges from the photosensitive member after the black toner image forming processes; and (f) means for, after the charge removal, setting a second charged potential of the photosensitive member in the yellow image forming processes in the range of 300 V to 700 V.

12. An apparatus for color electrophotography comprising:

(a) a photosensitive member;

(b) means for charging the photosensitive member to a first potential in a black charging process;

(c) means for, after the first charging process, exposing the photosensitive member to light representative of black information in a first exposure process, thereby forming a first electrostatic latent image corresponding to the black information on the photosensitive member;

(d) black toner;

(e) means for developing the first electrostatic latent image into a black toner image by use of the black toner in a first development process;

(f) means for charging the photosensitive member to a second potential in a yellow charging process after the first development process, the second potential being equal to or lower than the first potential;

(g) means for exposing the photosensitive member to light representative of yellow information in a second exposure process after the second charging process, thereby forming a second electrostatic latent image corresponding to the yellow information on the photosensitive member;

(h) yellow toner; and (i) means for developing the second electrostatic latent image into a corresponding yellow image by use of the yellow toner in a second development process, wherein the black and yellow toner images form a composite color toner image.

13. The apparatus of claim 12 wherein the first potential is equal to or higher than 700 V and the second potential is in the range of 300 V to 700 V.

14. The apparatus of claim 12 further comprising means for removing charges from the photosensitive member after the first development process but before the yellow charging process.

* * * * *